US005384973A

United States Patent [19]

Lyden

[11] Patent Number: 5,384,973

[45] Date of Patent: Jan. 31, 1995

[54] SOLE WITH ARTICULATED FOREFOOT

[75] Inventor: Robert M. Lyden, Beaverton, Oreg.

[73] Assignee: Nike, Inc., Beaverton, Oreg.

[21] Appl. No.: 992,894

[22] Filed: Dec. 11, 1992

[51] Int. Cl.[6] ..... A43B 13/14; A43B 5/00

[52] U.S. Cl. ..... 36/25 R; 36/102; 36/59 C; 36/31; D2/951

[58] Field of Search ..... 36/25 R, 114, 102, 103, 36/31 R, 141, 28, 32 R, 30 R, 59 C, 94; D2/310, 320

[56] References Cited

U.S. PATENT DOCUMENTS

| | | | |
|---|---|---|---|
| 80,037 | 7/1868 | Von Ausdall . | |
| D. 115,636 | 7/1939 | Sperry . | |
| D. 278,851 | 5/1985 | Austin . | |
| 280,791 | 7/1883 | Brooks . | |
| 500,385 | 6/1893 | Hall | 36/103 |
| 500,385 | 6/1893 | Hall . | |
| ,855,452 | 4/1932 | Jones . | |
| 900,867 | 10/1908 | Miller . | |
| 1,850,752 | 3/1932 | Ice et al. . | |
| 2,124,986 | 7/1938 | Pipes . | |
| 2,155,166 | 4/1939 | Kraft . | |
| 2,162,912 | 6/1939 | Craver . | |
| 2,328,242 | 8/1943 | Witherill | 36/25 R |
| 2,345,831 | 4/1944 | Pierson . | |
| 2,717,462 | 9/1955 | Goin . | |
| 3,005,272 | 10/1961 | Shelare et al. . | |
| 3,295,230 | 1/1967 | Szerenyi et al. . | |
| 3,487,563 | 1/1970 | Austin . | |
| 3,757,434 | 9/1973 | Granger, Jr. . | |
| 3,849,915 | 11/1974 | Inohara . | |
| 3,967,390 | 7/1976 | Anfruns | 36/1 |

(List continued on next page.)

FOREIGN PATENT DOCUMENTS

| | | |
|---|---|---|
| 337366 | 4/1904 | France . |
| 22515 | 7/1921 | France . |
| 680698 | 9/1939 | Germany . |
| 3741444 | 7/1988 | Germany . |
| 3927617 | 2/1991 | Germany . |
| 471179 | 9/1937 | United Kingdom . |
| 2226746 | 7/1990 | United Kingdom . |
| WO91/05491 | 5/1991 | WIPO . |
| WO91/11924 | 8/1991 | WIPO . |
| WO91/11929 | 8/1991 | WIPO . |
| WO91/19429 | 12/1991 | WIPO . |
| WO92/07483 | 5/1992 | WIPO . |
| WO93/00838 | 1/1993 | WIPO . |

OTHER PUBLICATIONS

*The Running Shoe Book,* by Peter R. Cavanagh, Ph.D., Chapter 2, p. 36, ©1980.

Fall 1991 Nike Footwear Catalog.

Spring 1992 Nike Footwear Catalog.

Fall 1992 Nike Footwear Catalog.

Athletics: The Way of Five Rings, by Robert M. Lyden, ©1987.

Physical Therapy, "Glossary of Biomechanical Terms, Concepts, and Units", by Mary M. Rodgers and Peter R. Cavanagh, vol. 64, No. 12, Dec. 1984, pp. 1886–1901.

The Running Shoe Book, by Peter R. Cavanagh, Ph.D., ©1980.

*Primary Examiner*—Paul T. Sewell

*Assistant Examiner*—M. D. Patterson

*Attorney, Agent, or Firm*—Banner, Birch, McKie & Beckett

[57] ABSTRACT

A sole having an articulated forefoot includes a flex joint extending generally longitudinally between the hallux and the second toe and at least one additional flex joint extending transversely across the sole. The flex joints can intersect with each other to form substantially separated sections in the sole by for facilitating relatively independent movement of selected toes.

14 Claims, 8 Drawing Sheets

U.S. PATENT DOCUMENTS 4,059,910 11/1977 Bryden et al. ..... 36/103
4,241,524 12/1980 Sink ..... 36/102
4,262,435 4/1981 Block et al. ..... 36/25 R
4,266,349 5/1981 Schmohl ..... 36/59 C
4,309,832 1/1982 Hunt .
4,377,041 3/1983 Alchermes ..... 36/31
4,393,605 7/1983 Spreng ..... 36/114
4,439,936 4/1984 Clark et al. .
4,476,638 10/1984 Quacquarini et al. ..... 36/103
4,527,345 7/1985 Lopez Lopez .
4,554,749 11/1985 Ostrander ..... 36/102
4,557,059 12/1985 Misevich et al. .
4,559,724 12/1985 Norton ..... 36/129
4,562,651 1/1986 Frederick et al. ..... 36/102
4,615,126 10/1986 Mathews ..... 36/102
4,628,936 12/1986 Langer et al. ..... 36/31
4,676,010 6/1987 Cheskin ..... 36/31
4,745,927 5/1988 Brock ..... 36/94
4,779,361 10/1988 Kinsaul .
4,785,557 11/1988 Kelley et al. .
4,837,949 6/1989 Dufour ..... 36/25 R
4,864,739 9/1989 Maestri .
5,024,007 6/1991 Dufour ..... 36/25 R
5,048,203 9/1991 Kling ..... 36/25 R

SOLE WITH ARTICULATED FOREFOOT

FIELD OF THE INVENTION

The invention pertains to footwear, and in particular to footwear having articulated soles. The sole of the present invention has particular usefulness in athletic shoes.

BACKGROUND OF THE INVENTION

The modern athletic shoe is a highly refined combination of elements which cooperatively interact in an effort to minimize weight while maximizing comfort, cushioning, stability and durability. However, these goals are potentially in conflict with each other in that the efforts to achieve one of the objectives can have a deleterious affect on one or more of the others. As a result, the shoe industry continues in its efforts to optimize the competing qualities of cushioning, durability and stability.

In athletic shoes the sole ordinarily has a multi-layer construction comprised of an outsole, a midsole and an insole. The outsole is normally formed of a durable material to resist wearing of the sole during use. In many cases, the outsole includes lugs, cleats or other elements to enhance the traction afforded by the shoe. The midsole ordinarily forms the middle layer of the sole and is typically composed of a soft foam material to cushion the impact forces and pressure experienced by the foot during athletic activities. The foam midsole may be formed with or without the inclusion of other cushioning elements, such as a resilient inflated bladder. An insole layer is usually a thin padded member provided overtop of the midsole to enhance the comfort afforded to the wearer.

Up until about the 1970's, however, athletic shoes were by and large considered deficient in providing cushioning for the wearer's foot. Consequently, numerous injuries were sustained by those engaging in athletic activities. To overcome these shortcomings, over the ensuing years manufacturers focused their attention upon enhancing the cushioning provided by the athletic shoes. To this end, midsoles have over time been increased in thickness. These endeavors have further led to the incorporation of other cushioning elements within the midsoles (e.g., resilient inflated bladders) and other sole configurations intended to provide enhanced cushioning effects. The industry's focus on improving cushioning has resulted in a marked improvement of shoes in this regard. However, footwear stability has not always been so successfully addressed. In fact, the benefits realized in cushioning have sometimes led to a degradation of the shoe's stability.

To appreciate the potential harmful affects that could be attributed to instability, it is important to have a basic understanding of the dynamics of running. While the general population includes a wide variety of running styles, most people run in a heel-to-toe manner. However, in this running style the foot does not normally engage the ground in a simple back to front linear motion. When a person runs, the feet generally engage the ground under the approximate midline of their body, rather than to the sides as in walking (FIG. 15). As a result, the foot is tilted upon ground contact such that initial engagement with the ground (commonly referred to as the "rearfoot strike") usually occurs on the lateral rear comer of the heel. At rearfoot strike, then, the foot is ordinarily oriented with the big toe pointing upward and slightly outward. As the ground support phase progresses, the foot is lowered to the ground in a rotative motion such that the sole comes to be placed squarely against the ground. Inward rotation of the foot is known as eversion and, in particular, inward rotation of the calcaneus associated with articulation of the subtalar joint is known as rearfoot pronation. While, eversion is itself a natural action, excessive pronation, or an excessive rearward rate of pronation is sometimes associated with injuries among runners and other athletes.

Other running styles also include similar movements. For instance, runners who engage the foot at points other than the heel still tend to initially engage the ground along the lateral edge of the shoe. Thereafter, the foot similarly rotates inwardly so that the sole rests squarely on the ground. Some runners experience an outward rotation of the foot, known as inversion and supination, rather than the conventional inward rotation. Similar stability problems due to excessive rotations, or rate of rotation of the foot are sometimes attributed to the presence of varus and valgus conditions regarding the anatomy of the wearer (FIGS. 16–19). In general, varus and valgus conditions exist when the forefoot and/or midfoot including the metatarsals are oriented at an inclination with respect to the rearfoot such that the calcaneus is caused to pronate or supinate, respectively, when the sole of the wearer's foot is placed flush on the ground. Under these conditions, the foot pronates or supinates with every step and indeed even with standing, and can exacerbate the rotation under more demanding conditions such as exists in running. Lastly, rotative motions may be associated with lateral movements, as commonly seen in basketball.

In a natural barefoot condition a person's foot is normally provided with certain adaptations and mechanics which function to avoid the stability problems associated with rotative movements, irrespective of whether the rotation is due to running, lateral movements, or the presence of a varus/valgus condition. While the foot has the capacity to counter and stabilize supination of the foot, perhaps the more salient stabilizing qualities of the foot are directed to controlling pronation. In particular, a large number of the joints and connective tissues of the lower leg and foot cooperatively function to effect and control the foot's movements. The human "body" is able to process complex "information" and successfully use these natural mechanics to respond to performance demands relevant to stability requirements in fractions of a second. Moreover, through neuromuscular learning an individual is able to maximize the use of their anatomical endowment by anticipating upcoming events and responding accordingly.

The skeletal framework of the foot provides the requisite strength to support the weight of the body through wide ranges of activities. The foot is made up of 26 interconnected bones (FIGS. 11–14). While many of the joints between these bones are relatively inflexible due to the attachment of ligaments, a number of movable joints important to natural foot stability are present. The bones in the foot are commonly identified into three main groups: tarsus (the posterior group), metatarsus (the middle group) and phalanges (the anterior or distal group).

The foot is interconnected to the leg via the tarsus. More specifically, the tibia 10 and the fibula 11 (i.e., the leg bones) are movably attached to the talus 18 to form the ankle joint 15. In general, the leg bones 10, 11 form a mortise into which a portion of talus 18 is received to form a hinge-type joint which allows both dorsi flexion (upward movement) and plantar flexion (downward movement) of the foot. Talus 18 overlies and is movably interconnected to the calcaneus 19 (i.e., the heel bone) to form the subtalar joint 27. Subtalar joint 27 enables the foot to move in a generally rotative, side-to-side motion. Rearfoot pronation and supination of the foot is generally associated with movement about this joint. Along with talus 18 and calcaneus 19, the tarsus further includes navicular 20, cuboid 21 and the outer, middle and inner cuneiforms 22–24. The four latter bones 21–24 facilitate interconnection of the tarsus to the metatarsus.

The metatarsus is comprised of metatarsals 31–35. Metatarsals 31–35 are relatively long bones which extend forwardly across the middle part of the foot to interconnect the tarsus and the phalanges. Each of the metatarsals are aligned with and connect to one of the phalanges. For example, the first metatarsal 31 is connected to the hallux 40 (i.e., the big toe), whereas the fifth metatarsal 35 is connected to the fifth or smallest digit 44. The first, second and third metatarsals 31–33 are attached on their proximal ends to the outer, middle and inner cuneiforms 22–24, respectively. The fourth and fifth metatarsals 34, 35 are both connected to cuboid 21.

The phalanges are the bones which associated with the toes. The phalanges include 14 bones altogether. The hallux 40 (i.e., the big toe) includes the distal phalange of the hallux **40*a* and the proximal phalange of the hallux 40*b*. The remaining phalanges of the second to fifth digits 41–44 (i.e., the small toes) are each comprised of a distal phalanx 41*a*, 42*a*, 43*a*, 44*a*, a middle phalanx 41*b*, 42*b*, 43*b*, 44*b*, and a proximal phalanx 41*c*, 42*c*, 43*c*, 44*c*. The phalanges of toes 40–44, and especially hallux 40**, are hingedly attached to the metatarsals for significant movement. As discussed below, these movements can play an integral role in controlling eversion and inversion of the foot. As a practical matter, the hallux is by far the prominent toe with respect to supporting weight, providing propulsive force and stabilizing eversion of the foot.

The muscles in the foot are interconnected with the bones of the foot to impart the desired motions (FIGS. 20–24). The muscles having the primary responsibility for controlling eversion are the tibialis posterior 52, flexor digitorum longus 53, flexor hallucis longus 54, extensor hallucis longus 55 and tibialis anterior 56. All of these muscles 52–56 are large and powerful muscles which originate in the lower leg and attach to various bones in the foot. The peroneus longus 57, peroneus brevis 58 and extensor digitorum longus 59 for toes 41–44 perform as evertors of the foot and aid in controlling inversion.

Tibialis posterior 52 is attached to the posterior of tibia 10 and to the plantar side of navicular 20 and cuneiforms 22–24 (FIGS. 20, 23 and 24). The tendon associated with muscle 52 wraps around a groove in the medial malleolus portion of tibia 10 which functions as a fulcrum point to enable the muscle to impart force the navicular and cuneiforms. The action of muscle 52 enables it to counter rearfoot pronation of the foot.

Flexor digitorum longus 53 also originates along the posterior of tibia 10 (FIGS. 20–22). This muscle is connected on its distal end to the plantar sides of the distal phalanges of each of the second through fifth digits. The tendon associated with muscle 53 is also wrapped about a medial malleolus tibia 15 portion of which acts as a fulcrum point to enable force to be applied the plantar side of toes 41–44. This muscle functions to collectively plantar flex (i.e., bend or curl downward) the small toes of the foot.

The flexor hallucis longus 54 and extensor hallucis longus 55 are both attached to hallux 40 to facilitate plantar flexion (i.e. downward bending) and dorsi flexion (i.e., upward movement) thereof, respectively (FIGS. 20–21). In particular, flexor hallucis longus 54 is attached to the posterior of fibula 11 and to the plantar side of hallux 40. The tendon associated with muscle wraps around a medial groove in talus 18 and calcaneus 19 which functions as a fulcrum point to direct force to the plantar side of hallux 40. Extensor hallucis longus 56 connects to an anterior part of the tibia 10 and along the dorsal side of hallux 40. The connection of these two powerful muscles to only the hallux provides a considerable range of movement and strength to the digit.

Tibias anterior 55 attaches to an anterior portion of tibia 10 and along the first metatarsal 31 (FIG. 20). Muscle 55 functions to counter eversion and enable inversion of the foot. Also, by connecting to first metatarsal 31, the muscle additionally increases the strength of movement of hallux 40.

While a multiplicity of intrinsic muscles in the foot are also involved in causing and controlling eversion and inversion, they are much smaller and hence have a diminished role in comparison to the above-discussed muscles. A full discussion of these muscles has therefore been omitted.

As can be readily appreciated, the muscles associated with plantar flexion of the toes roughly divide the stability operations of the foot into two parts. One part is comprised of the strong, dominant hallux 40 which is independently moved and controlled, e.g., by a pair of large, powerful muscles 54, 55. The other part is comprised of the lesser but still important remaining digits 41–44 which are collectively controlled for movement independent of hallux 40, e.g., by muscle 53 and an extensor muscle (not shown). The independent and strong movements of these two parts are important contributors to an individual's ability to control eversion and inversion.

The shoe industry's focus on improving cushioning has led to the use of thickened midsole elements. Increased thicknesses in the midsole, while accomplishing its purpose of enhancing cushioning, have also tended to make soles increasingly inflexible. This reduced flexibility in the sole can substantially limit the ability of hallux 40 and other toes 41–44 to perform their natural stabilizing movements. Moreover, the inflexibility of the sole inhibits the ability of hallux 40 to act independently of the other toes, which further diminishes the ability of the foot to stabilize itself. In many of today's shoes the toes have a limited freedom of motion and are forced to move in an essentially monolithic manner. Increased demands for resistance to excessive eversion or inversion can be placed upon muscles which have tendons inserting to the middle portions of the foot, such as the tibialis posterior 52, tibialis anterior 56, and peroneus longus 57. These structures can thereby be overloaded. As a result, the combined effects of a relatively inflexible outsole and a thick midsole can reduce the foot's ability to respond and control eversion, inversion and other rotative motions.

Further, the use of a thickened midsole raises the foot to a higher level above the ground as well as forming a less flexible member. This combination of features exacerbates potential stability problems. More specifically, during heel strike, the sole initially engages the ground along the rear lateral portion of the sole. Due to the relative relative stiffness in compression of the soles of conventional footwear, this contact functions as a fulcrum point about which a lever arm is created as the foot rotates as it is lowered to the ground. As a result the conventional sole is not able to match the lesser rotation which occurs in the natural barefoot condition. As can be appreciated, the combined effects of raising the foot higher above the ground, using a relatively inflexible sole, and the creation of an extended lever arm can cause the shoe to rotate medially, at a faster rate and to a greater degree than would otherwise be experienced. The possible detrimental affects of pronation can be furthered as a result of the foot's reduced capacity to stabilize such motion through active use of the toes.

The reduced flexibility of the sole can also hinder the ability of the foot to attain a powerful and smooth propulsive movement. In an effort to offset this shortcoming, many manufacturers have incorporated a feature known as "toe spring" into their soles. The term "toe spring" is a misnomer, however, since it does not involve any springing of the toes. Instead, toe spring merely refers to the upward rounding of the front end of the sole, to enable the sole to roll off the ground in a smoother fashion during the propulsive portion of the ground support phase of the step. This construction finds its historical origin, e.g., in wooden dutch shoes which embody the ultimate in inflexible soles. While the introduction of toe spring can achieve a smoother roll off for the modern shoe, this upward rounding of the sole can further reduce the ability of the wearer to utilize the toes effectively in stabilizing the foot and in effecting propulsion, in particular with respect to high speed movements, ballistic jumping, or when rapid lateral movements are required.

The problems associated with a thickened sole were alleviated to some extent by the use of a V-shaped groove construction as disclosed in U.S. Pat. No. 4,562,651 to Frederick et al. The increased flexibility provided by these grooves permitted the wearer to more easily dorsi flex the toes but offered little in the way of permitting plantar flexion of the toes. Moreover, the V-groove construction did not alter the generally monolithic movement of the toes, or facilitate independent flexion of the toes. Hence, the stability and performance of athletic footwear in this regard was not dramatically enhanced.

A Tiger marathon shoe of the 1950's partitioned the entire toe box into two encapsulated compartments. The big toe was inserted into the medial compartment, whereas the smaller toes were received into the lateral compartment. Each compartment was enclosed on all sides by the upper and sole such that a complete slot extends rearwardly in the shoe between the compartments. Although this construction would readily increase the independent movement of the big toe, the insertion of two layers of upper material as well as the double row of stitching and/or adhesive used to attach a conventional upper to a conventional sole between the wearer's toes could cause toes to experience considerable chafing.

U.S. Pat. No. 3,967,390 to Anfruns also discloses a shoe provided with compartments in the toe box. While Anfruns asserts that the construction enhances independent movement of the toes, the problems of chafing and frictional resistance discussed with respect to the Tiger shoe could potentially be magnified four fold with the additional slots defined in this construction. Indeed, due to the natural closer spacing found between the smaller toes the discomfort of this shoe would far exceed that of the Tiger shoe.

U.S. Pat. Nos. 4,837,949 and 5,024,007 to Dufour, German Patent No. 680,698 to Thomsen, and PCT Application No. WO 9105491 to Ellis each utilize some form of longitudinal and transverse grooves or hinges in its sole structure. However, none of these soles locate the grooves in locations that optimize the use of the structures of the foot, so that it can substantially function in a manner more consistent with the natural barefoot condition during athletic activities.

A limited amount of independent toe movement is afforded by those shoe uppers which provide sufficient clearance in the toe box to permit the toes to "scrunch up" or plantar flex inside of the shoe. Although this limited movement of the toes provides an incremental enhancement of stability, it falls far short of the performance afforded by the present invention. Also, in order to accommodate this sort of limited toe movement, a snug and comfortable fit of the upper about the foot is often sacrificed. The looser fit not only reduces running efficiency and comfort, but also tends to result in the formation of blisters or other irritations, in particular, during explosive lateral movements such as encountered in basketball and other similar activities.

SUMMARY OF THE INVENTION

The present invention pertains to a sole having the ability to maximize stability of the footwear without diminishing the qualities of cushioning and durability. The sole of the present invention enables a wearer to easily plantar and dorsi flex the hallux and other phalanges to a substantial degree and relatively independently of each other. As a result, the present sole allows the wearer to use the foot's natural mechanics to stabilize and control inversion, eversion, torsional and rotative movements of the foot—and particularly in regard to pronation.

The sole of the present invention includes a plurality of flex joints uniquely positioned with respect to the wearer's joints and muscles to facilitate an easier and independent movement of the toes to enhance shoe stability. One of the flex joints extends in a generally longitudinal direction between the hallux and the second phalange. At least one other flex joint extends transversely across the shoe and intersects the longitudinal flex joint to provide an effective means for maximizing the independence and freedom of motion available to the toes.

In a preferred construction additional patterns of flex joints are provided to make effective use of other joints and muscles in the foot important to stability. The enhanced flex joint patterns can permit the entire forefoot portion to resemble the natural barefoot condition during athletic activities.

DETAILED DESCRIPTION OF THE PREFERRED EMBODIMENTS

A sole formed in accordance with the present invention facilitates a wearer to stabilize rotative movements of the foot (e.g., inversion, eversion or torsional movements), whether induced by running, lateral movements or a structural variation from the norm such as a varus or valgus condition. For purposes of illustration, the present application discusses the invention in regard to modern athletic footwear. Nevertheless, the concepts of the invention would be applicable in other kinds of footwear as well.

Figure 1:
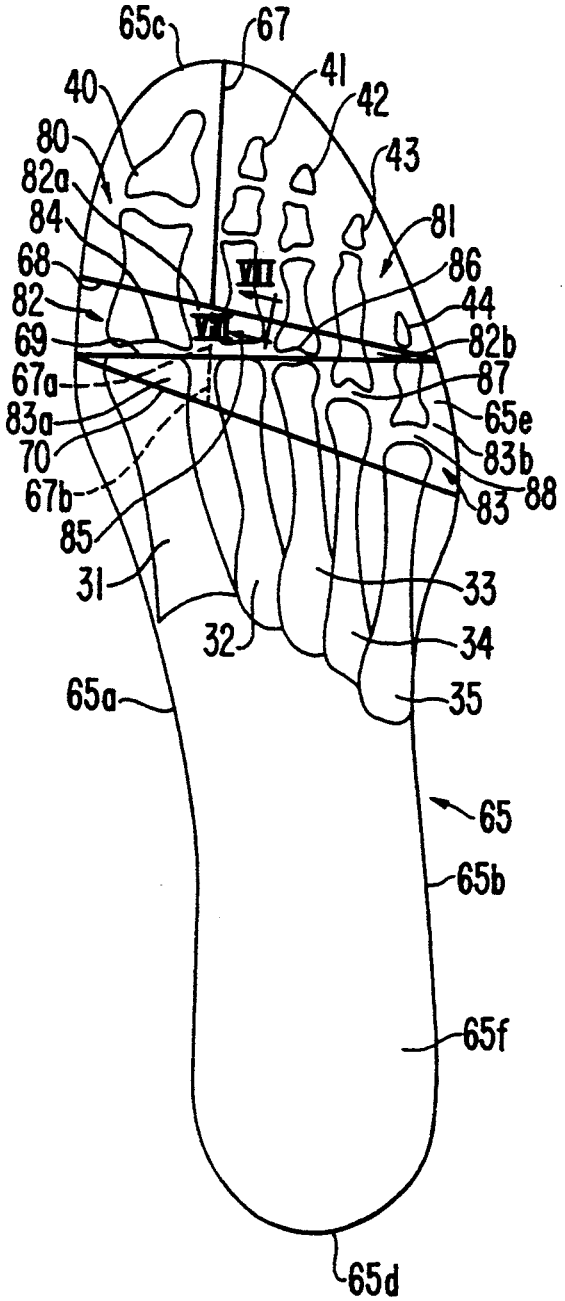
FIG. 1 is a bottom plan view of a sole in accordance with the present invention with the wearer's bones illustrated for clarity of the flex joint pattern.

In one of the preferred constructions of the present invention, a sole 65 has a medial side 65*a*, a lateral side 65*b*, a front end 65*c*, a rear end 65*d*, a forefoot portion 65*e* and a heel portion 65*f* (FIG. 1). Sole 65 includes a plurality of flex joints which easily enable the wearer to substantially and relatively independently flex hallux 40 as well as the other toes 41–44 as a collective group in order to enhance stability and athletic performance. The increased freedom of motion and independence for toes 40–44 would be particularly beneficial for activities involving high speed motion, ballistic jumping or rapid changes of directions, such as experienced for example in basketball.

Figure 3:
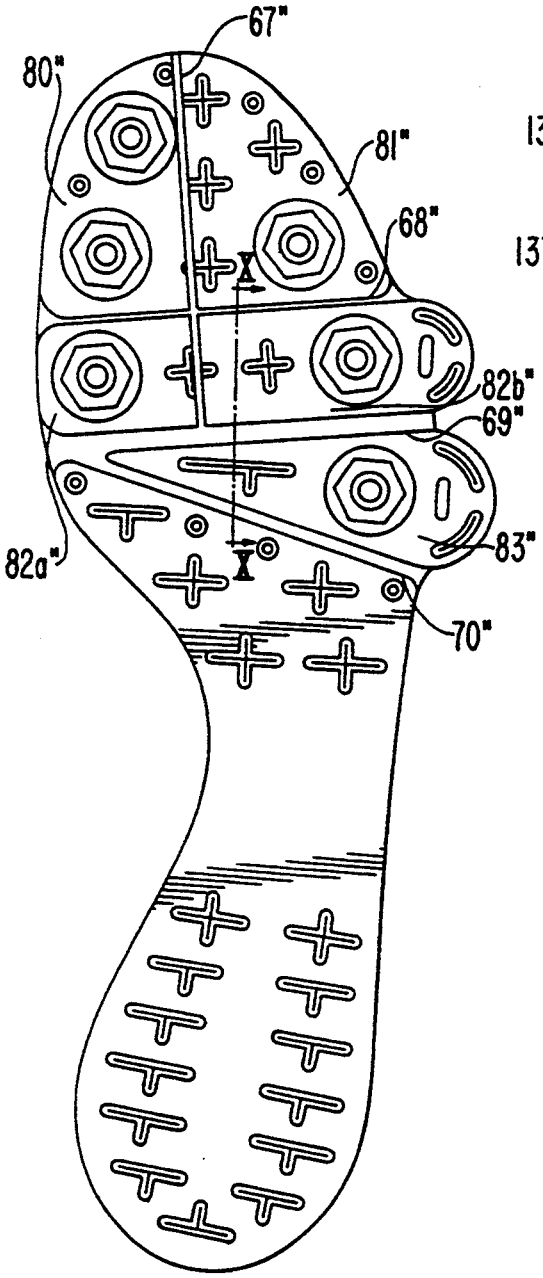
FIG. 3 is a bottom plan view of another alternate sole in accordance with the present invention.
Figure 5:
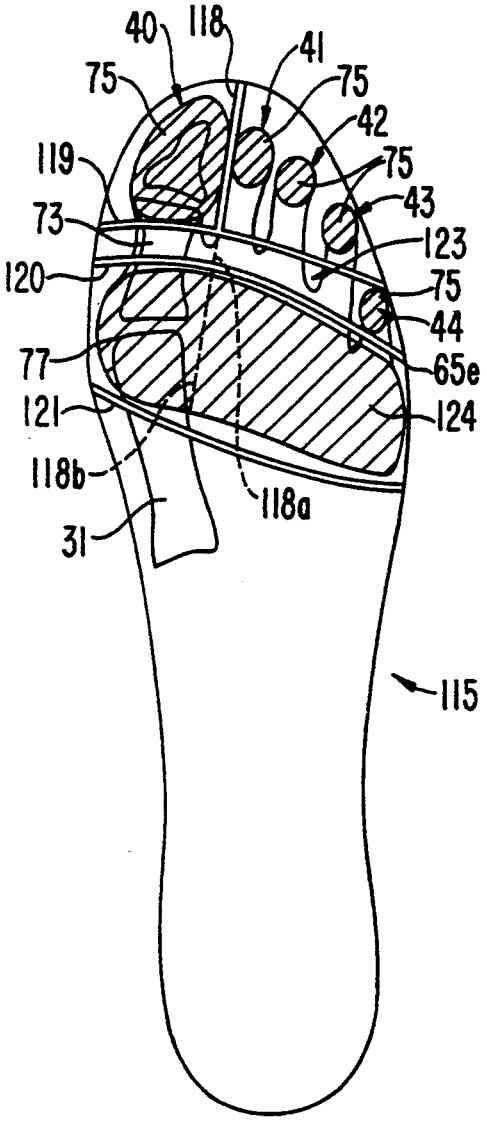
FIG. 5 is a bottom plan view of another alternate sole in accordance with the present invention with portions of the wearer's foot illustrated for clarity of the flex joint pattern.
Figure 12:
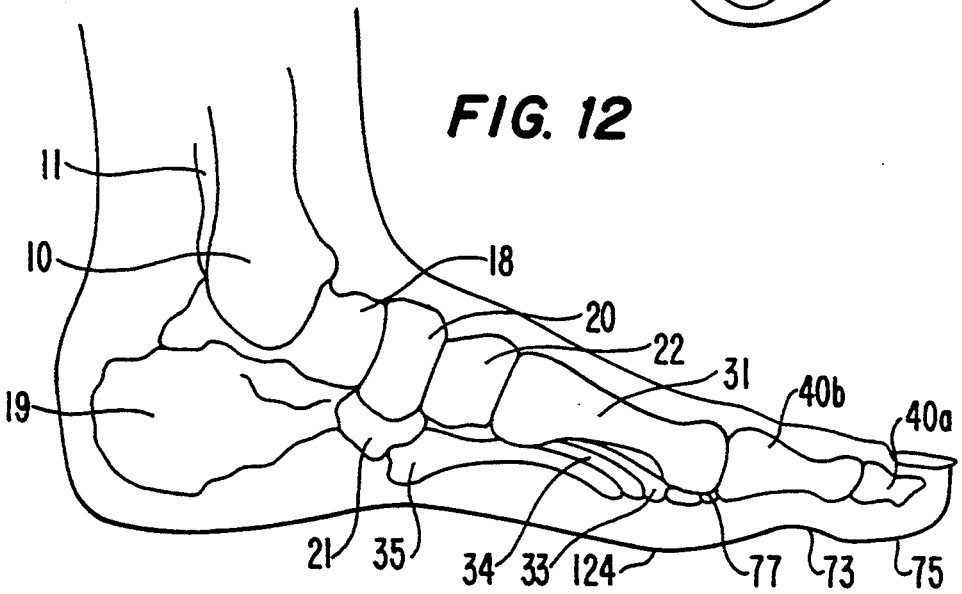
FIG. 12 is a medial side view of the bones of a person's foot.
Figure 13:
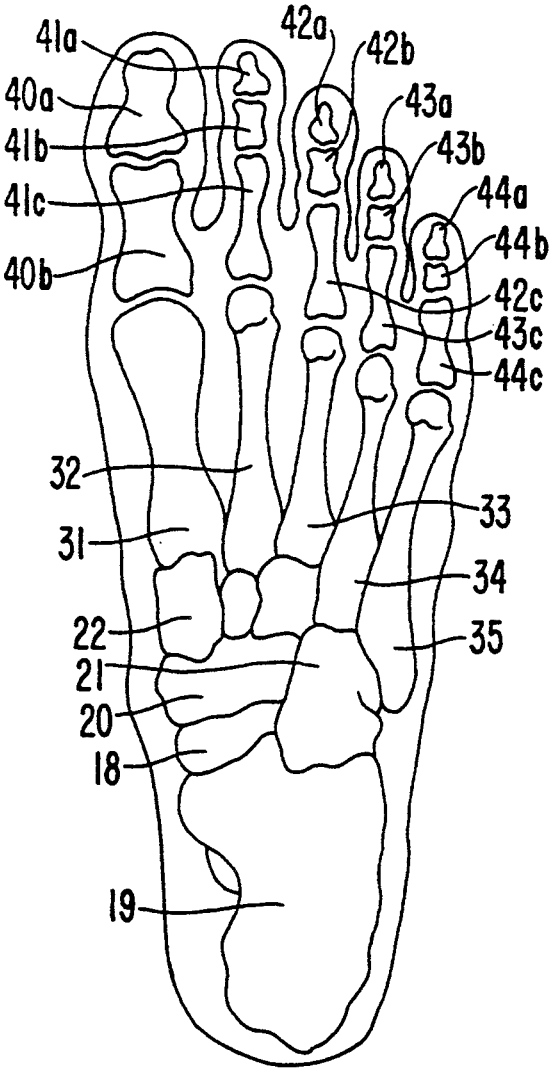
FIG. 13 is a bottom or plantar view of the bones of a person's foot.
Figure 15:
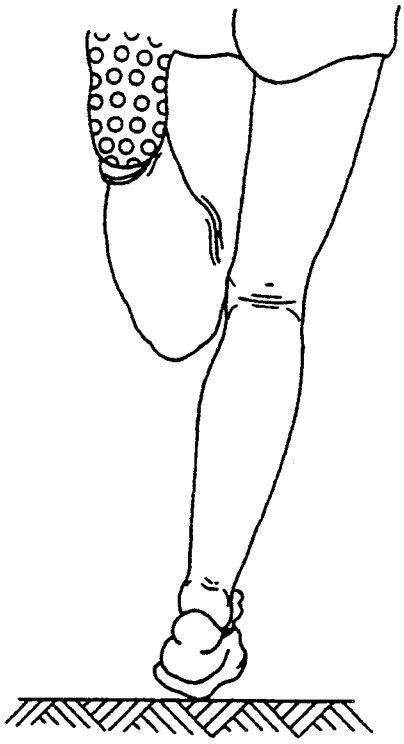
FIG. 15 is a rear view of a person engaged in a typical running style.
Figure 14:
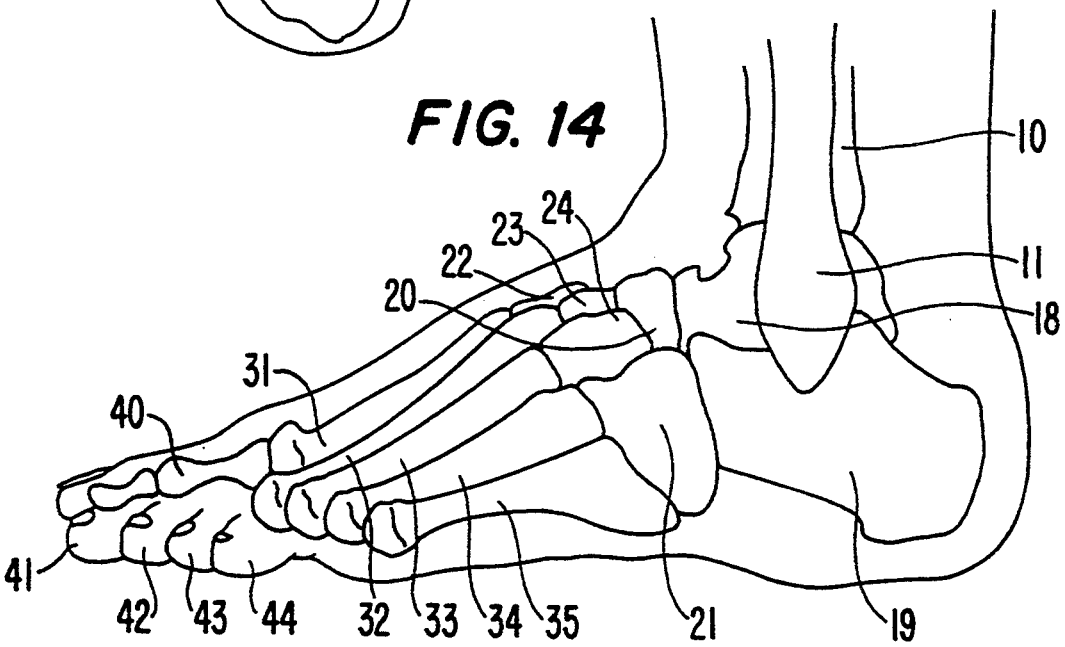
FIG. 14 is a lateral side view of the bones of a person's foot with the phalanges of the second through fifth toes omitted for clarity of view of the hallux.
Figure 16:
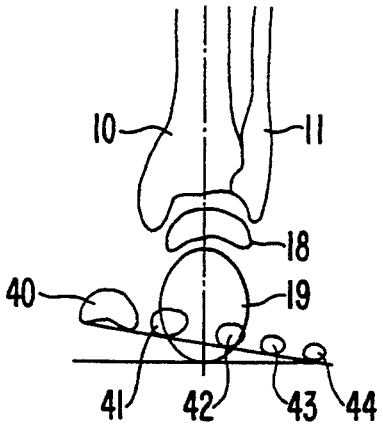
FIG. 16 is a rear schematic view of a foot and lower leg of a person having a varus condition.
Figure 17:
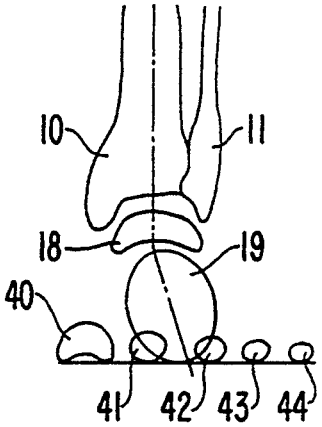
FIG. 17 is a rear schematic view of a pronated foot and lower leg of a person having a varus condition.
Figure 18:
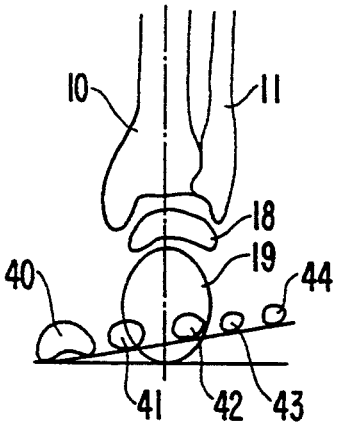
FIG. 18 is a rear schematic view of a foot and lower leg of a person having a valgus condition.
Figure 19:
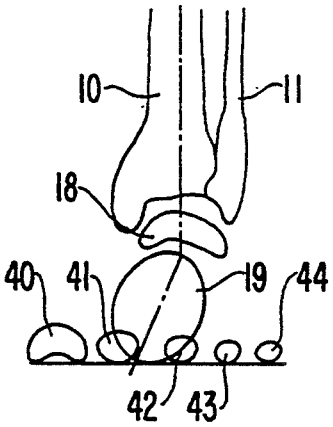
FIG. 19 is a rear schematic view of a supinated foot and lower leg of a person having a valgus condition.
Figure 20:
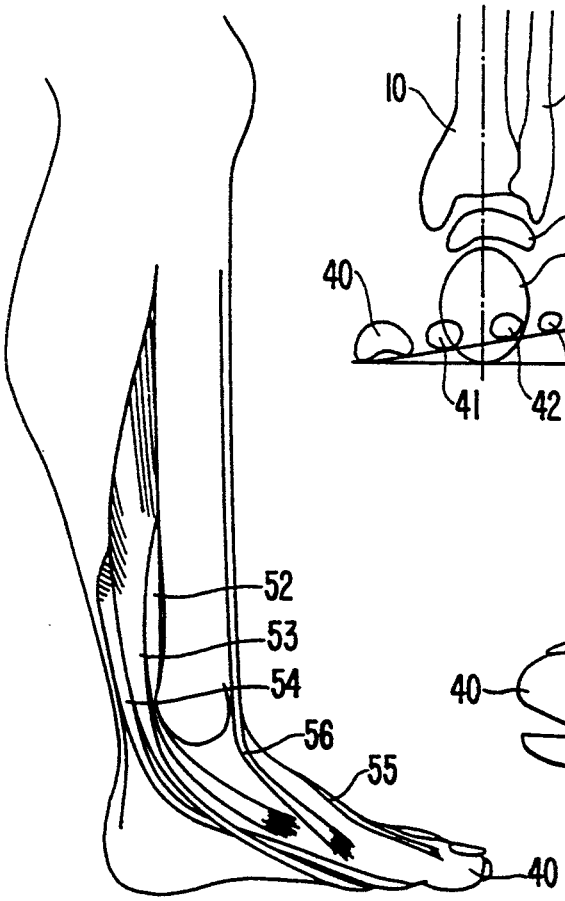
FIG. 20 is a medial side view of certain muscles in the foot and lower leg of a person.
Figure 25:
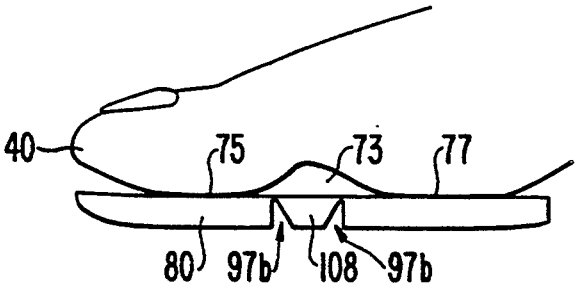
FIG. 25 is a fragmentary side view of the front end of a sole in accordance with the construction of FIG. 2.
Figure 22:
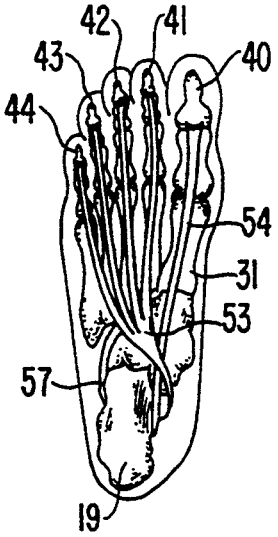
FIG. 22 is a bottom or plantar view of certain bones and muscles in the foot of a person.
Figure 21:
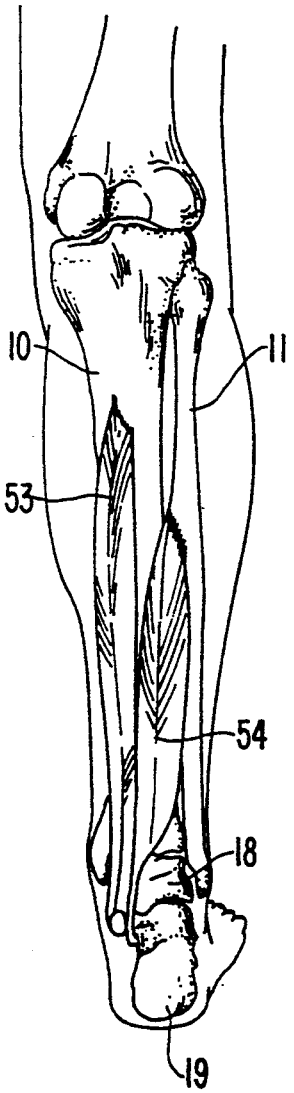
FIG. 21 is a rear view of certain bones and muscles in the foot and lower leg of a person.
Figure 23:
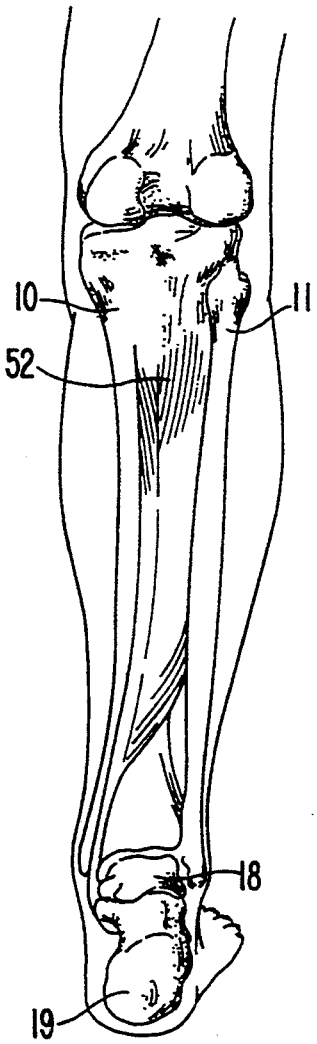
FIG. 23 is a rear view of certain bones and muscles in the foot and lower leg of a person.
Figure 24:
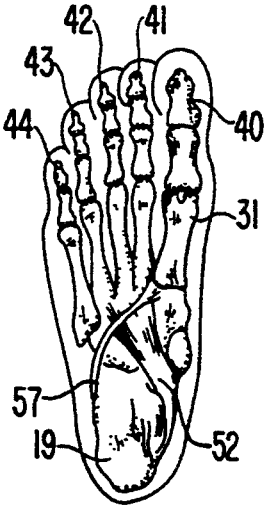
FIG. 24 is a bottom or plantar view of certain bones and muscles in the foot of a person.
Figure 26:
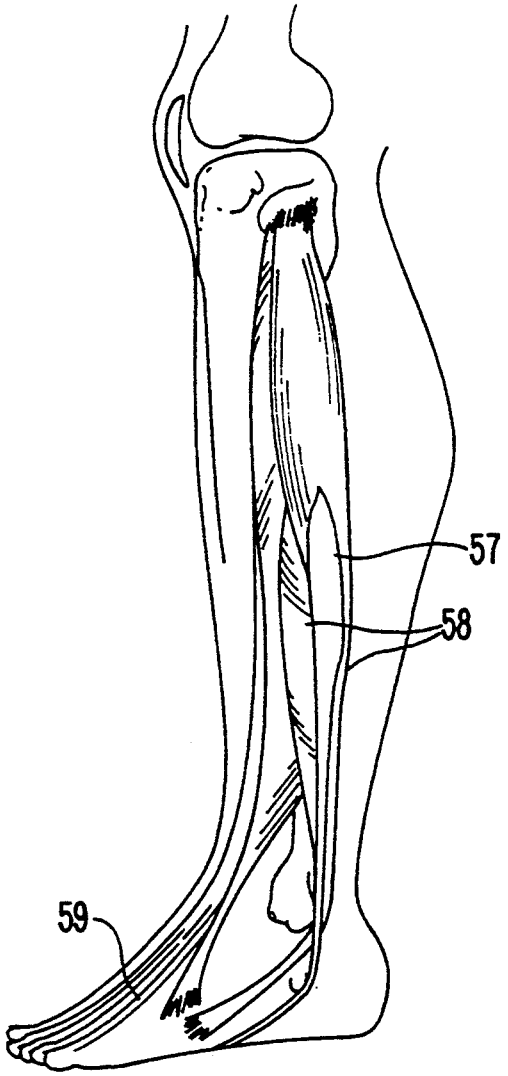
FIG. 26 is a lateral side view of certain muscles in the foot and lower leg of a person.

More specifically, sole 65 includes a longitudinal flex joint 67 and a plurality of transverse flex joints 68–70. Flex joint 67 extends in a generally longitudinal direction between hallux 40 and the adjacent toe 41 to separate hallux 40 from toes 41–44. A first transverse flex joint 68 extends across sole 65 at an inclination to the sole's longitudinal axis just rearward of toe pads 75 (as shown in FIGS. 5, 12 and 25). Flex joint 68 can however have different orientations as shown in FIG. 3. Flex joint 68 lies generally under cavity 73 defined between toe pads 75 and metatarsal heads 77 (FIGS. 1 and 12). Longitudinal flex joint 67 extends rearward from front end 65*c* to intersect with at least transverse flex joint 68. With this construction, the sole is subdivided into two relatively independently movable sections 80, 81. Section 80 is completely separated from the rest of the sole by flex joints 67 and 68. As can be appreciated, section 80 can be easily flexed in substantially all directions without having to overcome the overall inflexibility of the whole sole. Likewise, section 81 is also completely separated from the rest of the sole by flex joints 67, 68 to achieve the same benefits. Sections 80, 81 may also be partitioned by flex joints which are to a certain extent discontinuous (not shown). Isolation of hallux 40 on section 80 permits the wearer to maximize the use of muscles 54, 55 and thus facilitate use of the hallux to stabilize the foot. Likewise, isolation of the remaining toes 41–44 on section 81 corresponds to the collective connection of the extensor (not shown) and flexor 53 muscles to these toes. Hence, the capacity to stabilize the foot with these muscles is also greatly enhanced.

Sole 65 additionally includes a second set of flex joints 69–70 extending transversely across the sole in a general V-shaped orientation. The locations of these flex joints are in accordance with the teachings of U.S. Pat. No. 4,562,651 to Frederick et al incorporated by reference herein. Flex joint 69 extends generally across the metatarsal-phalange joints 84–85 of the first and second metatarsals 31–32. Flex joint 70 extends generally parallel to the metatarsal-phalange joints 86–88 of the third through fifth metatarsals 33–35 and toes 42–44. Although flex joints 68 and 69 and flex joints 69 and 70 are illustrated as intersecting at points on the sides 65*a*, 65*b* of the sole, the intersection of the flex joints may occur either inside or outside the confines of the sole. In any event, flex joints 69, 70 define additional sections 82, 83 which can also be separated from the rest of the sole. The provision of these movable sections 82, 83 enables toes 40–44 to be dorsi flexed or plantar flexed to a greater degree as their separation from the bulk of the sole is increased.

Longitudinal flex joint 67 may be extended rearward as at 67*a* or 67*b* to intersect flex joints 69, 70 and even further enhance the ability of the foot to stabilize rotative motion. This construction subdivides sections 82 and/or 83 into separate sections 82*a*, 82*b*, 83*a*, 83*b*. The increased subdivision of the forefoot along longitudinal flex joint 67 further increases the ability of the hallux and the group of smaller toes to operate independently of each other. Specifically, with this construction hallux 40 for example could plantar flex without having to substantially force sections 82*b*, 83*b* downward with it. The extension of the flex joint through the forefoot area 65*e* also allows an increased flexibility of the sole along metatarsals 31–35. This enables the sole to achieve more of a rolling action (approaching the natural barefoot condition) when rotating so that the sole moves more smoothly toward the ground during the ground support phase, rather than endure a more sudden "slapping" motion which commonly exists in the prior art. In addition, the extension of flex joint 67 through the forefoot portion 65*e* enhances the ability of muscles 56, 57 to control the foot's stabilizing movements. Although not preferred, many of the same benefits albeit to a lesser degree could be achieved by extending flex joint 67 to at least flex joint 69 and eliminating flex joint 68.

Figure 7:
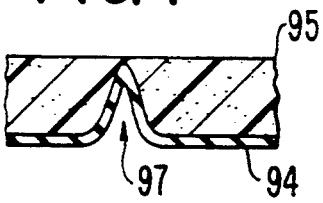
FIG. 7 is a cross sectional view taken along line VII—VII in FIG. 1.
Figure 8:
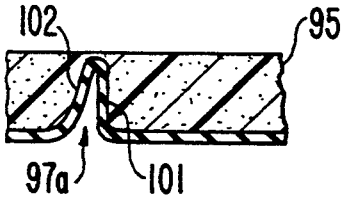
FIG. 8 is an alternate construction of the cross sectional view of FIG. 7.
Figure 9:
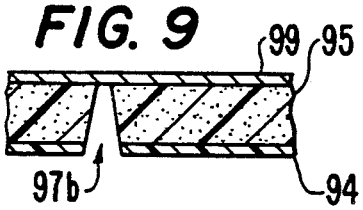
FIG. 9 is another alternate construction of the cross sectional view of FIG. 7.
Figure 10:
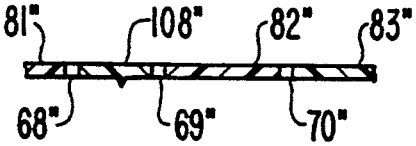
FIG. 10 is a cross sectional view taken along line X—X in FIG. 3.
Figure 11:
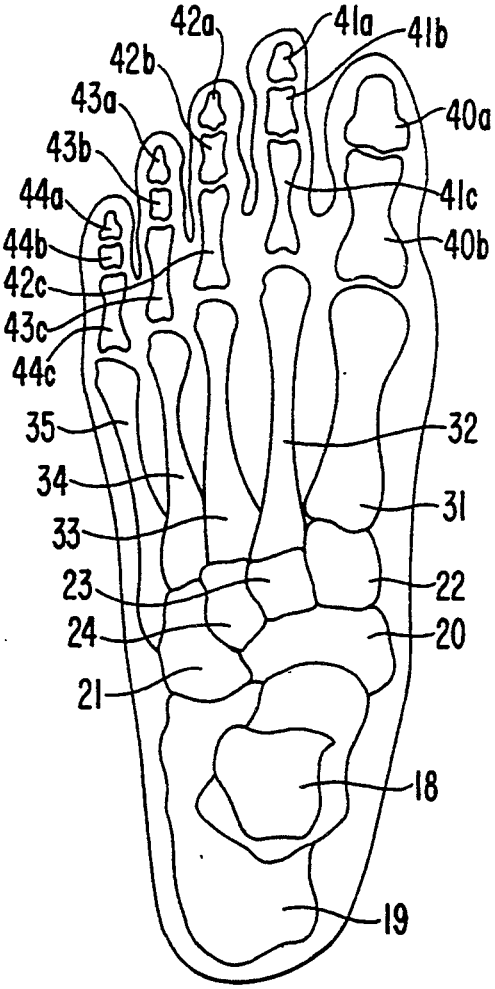
FIG. 11 is a top or dorsal view of the bones of a person's foot.

Flex joints 68–70 can be formed in the sole in a number of different ways (FIGS. 1, 3 and 7–10). For instance, outsole 94 and midsole 95 may cooperatively form the flex joints as V-shaped grooves 97 (FIG. 7). Alternatively, the flex joints may be formed as grooves having other shapes, such as groove 97*a* (FIG. 8). According to this embodiment, groove 97*a* is defined by an upright wall 101 and inclined wall 102. This type of groove may be useful if a greater freedom of movement is desired relative to the side of the groove adjacent inclined wall 102. The flex joints may also be formed as grooves 97*b* which are defined by simply removing or omitting a portion of the outsole 94*b* and midsole 95*b* (FIG. 9). Grooves 97*b* could be left open or filled partially or wholly with a highly elastic material. As shown in FIGS. 7–9, grooves 97, 97*a*, 97*b* are deep troughs which extend substantially through the sole in order to provide a significant level of flexibility. Layer 99 is a textile material, such as KEVLAR ®, adhered to the midsole and may function as the insole or as a support for the insole. Grooves of lesser depth or grooves having variable or differing depths may also be used. Furthermore, the flex joints may alternately be formed by providing a weakened construction or a material of greater elasticity along the desired flex joint location. One example of this type of construction is disclosed in a co-pending patent application entitled CHEMICAL BONDING OF RUBBER TO PLASTIC FOR USE IN ARTICLES OF FOOTWEAR, invented by Robert M. Lyden, Ross A. McLaughlin, Henry T. Chriss, Calvin M. Buck IV, Daniel R. Potter, and Steven Vincent, and filed on Dec. 10, 1992 under the docket number of 0127.37934, the information of which is incorporated herein by reference. According to this construction at least a portion of the sole would be formed by a mosaic of plastic plates bound together by a rubber material (FIGS. 3, 4, 10, and 27). The location of the rubber would correspond to the location of the flex joints. Of course, other flex joint constructions which permit the requisite flexing of the partitioned sections may also be used. Lastly, the flex joints could at least to some extent be discontinuous. For example, it may be desirous to interrupt flex joints 69, 70 under the ball of the foot because of the pressure experienced at that point in many athletic endeavors and the desire to avoid possibly degrading the quality of cushioning being afforded the wearer.

Figure 2:
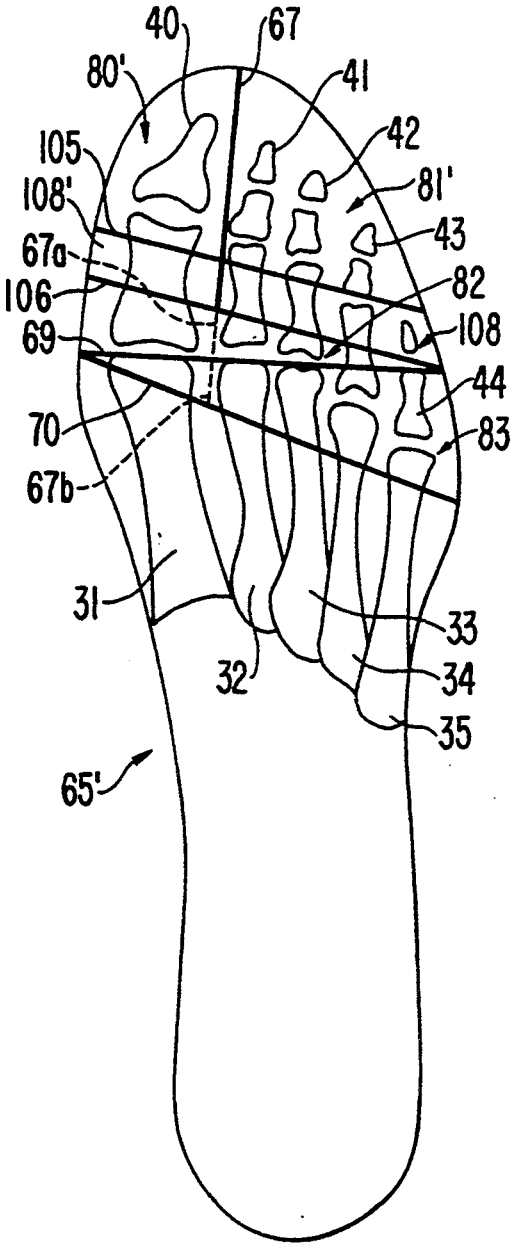
FIG. 2 is a bottom plan view of an alternate sole in accordance with the present invention with the wearer's bones illustrated for clarity of the flex joint pattern.

In a modified construction, sole 65' may include a pair of flex joints 105, 106 in place of the single transverse flex joint 68 (FIG. 2). Flex joints 105, 106 are closely spaced and extend approximately along the marginal sides of cavity 73 of the foot (except for the cavity defined by the fifth toe 44) to define a middle joint section 108 therebetween. The toe pad of the fifth toe 44 is neither sufficiently spaced from the corresponding metatarsal head nor of sufficient strength to exclude from section 108 in this particular embodiment. These flex joints 105, 106 are preferably parallel to each other, although this relationship is not essential. In this construction, plantar flexion of toes 40–44 may be provided a further dimension. In particular, as the toes 40–44 are curled downward and drawn rearward during plantar flexion, sections 108 and 108' are forced upward into cavity 73 to define a support ledge against which toes 40–44 may push. This type of action would be particularly advantageous for running the turns on a track or jumping.

Figure 4:
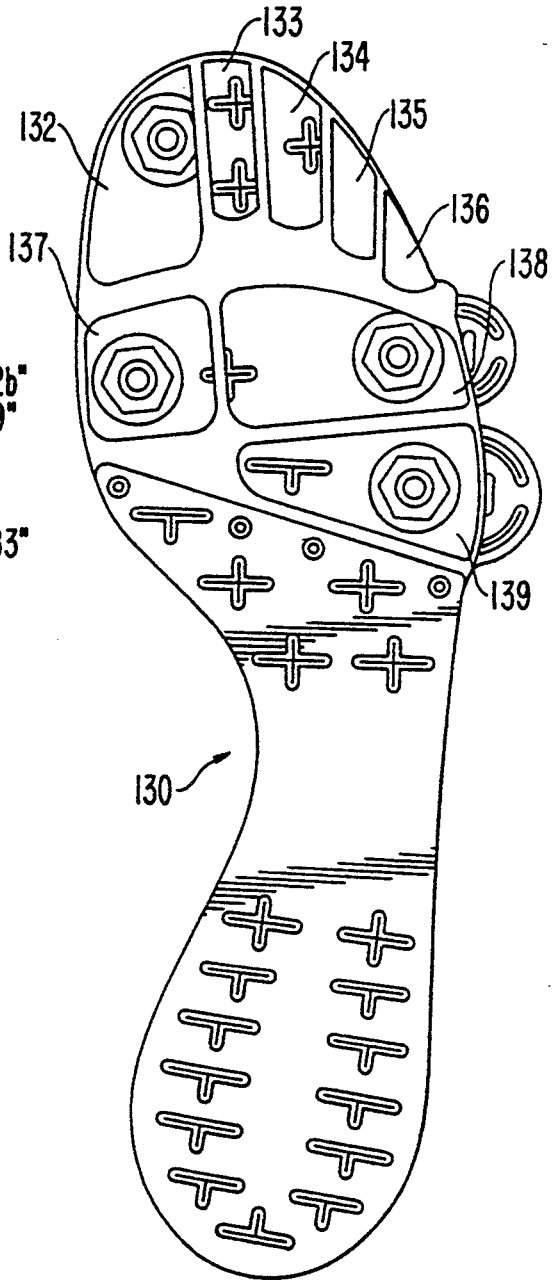
FIG. 4 is a bottom plan view of another alternate sole in accordance with the present invention.
Figure 27:
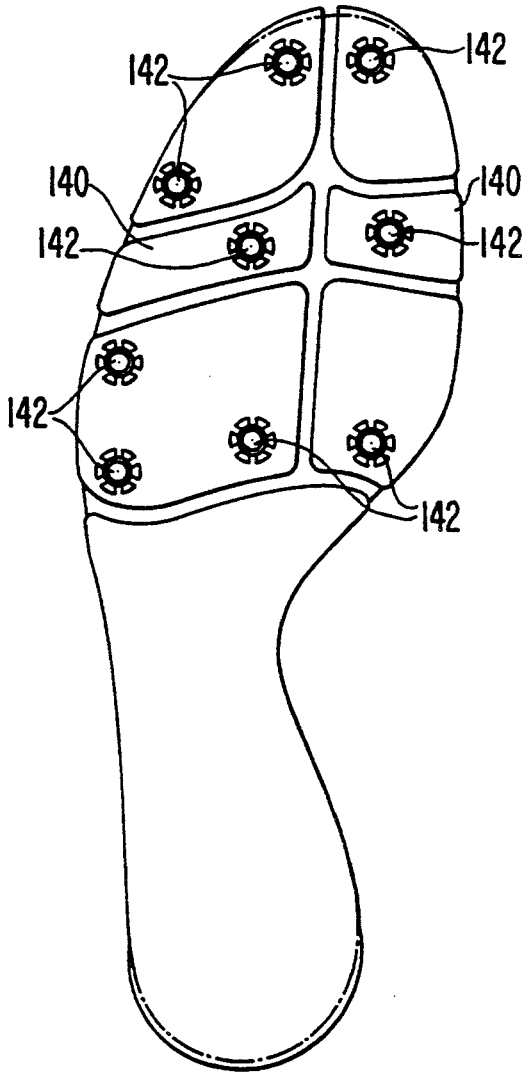
FIG. 27 is a bottom plan view of another alternate sole in accordance with the present invention.

Flex joints 105, 106 may be formed as a pair of opposing grooves 97*b* (FIG. 25). Alternatively, section 108, 108' may be defined as plastic plates interconnected to sections 80', 81' and 82 (FIG. 2) by a rubber material in the manner as disclosed in the above-noted co-pending application to Robert Lyden et al. entitled CHEMICAL BONDING OF RUBBER TO PLASTIC FOR USE IN ARTICLES OF FOOTWEAR. This type of construction is also illustrated in FIGS. 5 and 27, with sections 123, 140 being similar in structure and operation to sections 108, 108'. The provision of a spike 142 (or lugs not shown) on section 140 would augment the upward motion of the section and support the section against slippage upon the application of pressure by the toes. Moreover, all of the different plastic sections could collectively define an articulated spike plate (FIGS. 3, 4 and 27). Alternatively, they could be covered with individual outsole segments adhered along the bottom sides of the sections (not shown).

In another preferred construction, a sole 115 incudes a longitudinal flex joint 118 and a plurality of transverse flex joints 119–121 (FIG. 5). As with sole 65, flex joint 118 extends rearward between hallux 40 and second toe 41 to at least the first transverse flex joint 119. The flex joint 118 may be extended as at 118*a* to intersect second transverse flex joint 120. Flex joints 119, 120 extend along the marginal sides of cavity 73, in a manner similar to flex joints 105, 106, to define a joint section 123. Section 123 performs the same function as sections 108, 108'. As with sole 65, the flex joints of sole 115 partition the sole into separate, relatively independent movable sections which separately support hallux 40 by itself and toes 41–44 as a collective group. The flex joints may be formed in any of the ways discussed above with respect to sole 65.

Sole 115 further includes a third flex joint 121. Flex joints 120, 121 are used in lieu of the V-shaped arrangement of flex joints 69, 70 in sole 65 as a compromise between sole flexibility and comfort afforded by cushioning. In the forefoot area 65*e*, contact of the foot with the sole occurs along toe pads 75 and across a swath 124 defined along metatarsal heads 77. In general, flex joints 120, 121 are placed to each side of the contact swath 124 and posterior to toe pads 75. Although flex joints 120, 121 would provide sole 115 with less optimal lines of flexion than flex joints 69, 70 of sole 65, this arrangement enables greater cushioning and support to be provided under the main pressure points of the forefoot.

Flex joint 118 may also be extended to intersect flex joint 121 as at 118*b*. This extension would provide the same benefits as discussed above with respect to the extension of flex joint 67*b*.

Figure 6:
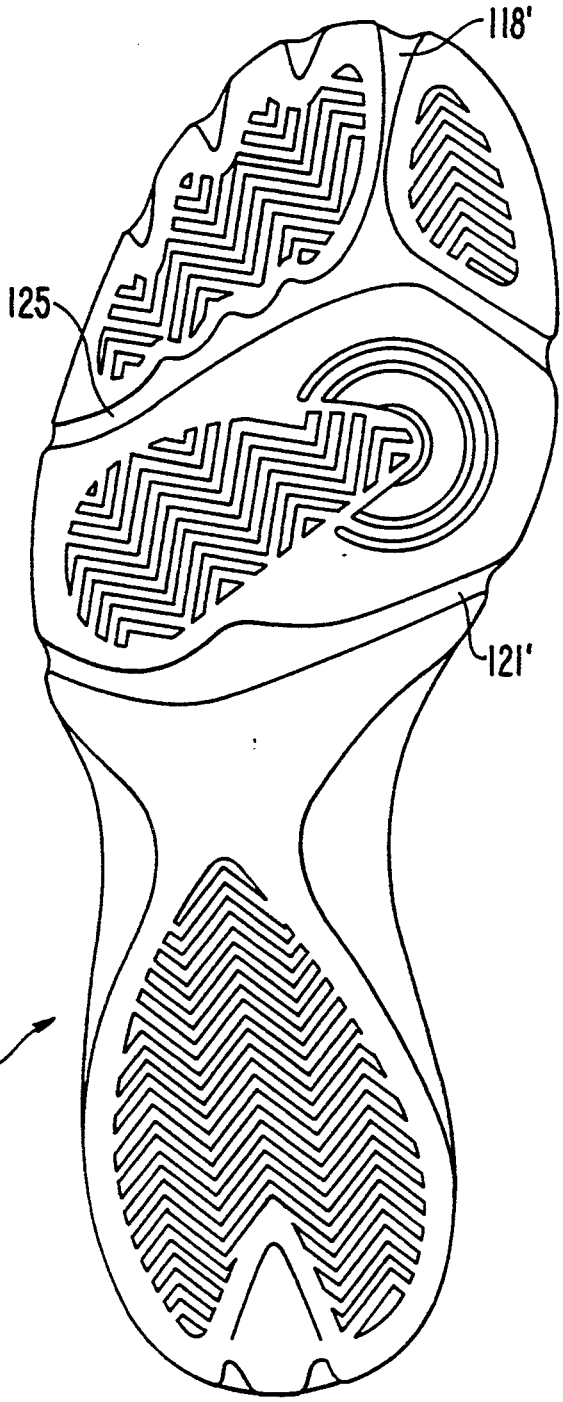
FIG. 6 is a bottom plan view of another alternate sole in accordance with the present invention.

This sole construction may be modified such that a single flex joint 125 in sole 115' replaces flex joints 119, 120 (FIG. 6). In this construction, flex joint 125 intersects longitudinal flex joint 118' to form the important independent sections 80', 81' for hallux 40 and phalanges 41–44, respectively. Flex joint 125 further cooperates with flex joint 121' to perform the same function as flex joints 120, 121.

The flex joints may also have a more irregular shape as in sole 130 (FIG. 4). In a preferred construction of this design, separate plastic sections 132–136 are provided for each toe, as well as for other forefoot portions 137–139. All of the sections 132–139 are bonded together by rubber under the process disclosed in the above-noted co-pending application to Robert Lyden et al. entitled CHEMICAL BONDING OF RUBBER TO PLASTIC FOR USE IN ARTICLES OF FOOTWEAR. Of course, irregular flex joints are not limited solely to this construction and may have the different constructions discussed above in regard to sole 65.

The above-discussion concerns the preferred embodiments of the present invention. Other flex joint patterns embodying the inventive concepts of the present invention may be used to achieve the same benefits. Moreover, various other embodiments as well as many changes and alterations may be made without departing from the spirit and broader aspects of the invention as defined in the claims.

I claim:

1. Footwear for receiving and supporting a foot of a wearer having a front end, a rear end, a medial side and a lateral side, said footwear further including an upper and a sole, said upper and said sole defining a cavity for receiving the foot, said cavity being continuously open from said medial side to said lateral side proximate said front end of said footwear whereby the toes of the wearer's foot are not subdivided within the cavity relative to each other, said sole comprising a first flex joint and a second flex joint, said first flex joint extending rearwardly in a generally longitudinal direction from said front end, said first flex joint being located to extend between the hallux and the second toe of the wearer's foot, said second flex joint extending in a generally transverse direction between said medial and lateral sides, said second flex joint being positioned generally between the metatarsal heads of the wearer's foot and the pads of a plurality of toes including at least the hallux and the second and third toes of the wearer's foot, said second flex joint intersecting said first flex joint to define a first supporting section receiving and supporting only the hallux and a second supporting section receiving and supporting only collectively a plurality of other toes including at least said second and third toes, said first and second supporting sections being subdivided from the remainder of said sole by said first and second flex joints whereby the hallux supported by said first supporting section is easily and relatively independently moved by the wearer with respect to the other toes and said toes collectively supported by said second supporting section can be easily and relatively independently moved as a collective group by the wearer with respect to the hallux, said sole further including a third flex joint extending transversely across said sole generally along the first two metatarsal heads of the wearer's foot and a fourth flex joint extending along a path generally parallel to a line intersecting the third, fourth and fifth metatarsal heads of the foot such that said third and fourth flex joints converge toward said medial side of said sole, said first flex joint extending rearward beyond said third flex joint to intersect with said fourth flex joint.

2. Footwear for receiving and supporting a foot of a wearer having a front end, a rear end, a medial side and a lateral side, said footwear further including an upper and a sole, said upper and said sole defining a cavity for receiving the foot, said cavity being continuously open from said medial side to said lateral side proximate said front end of said footwear whereby the toes of the wearer's foot are not subdivided within the cavity relative to each other, said sole having a top surface and a bottom ground-engaging surface, said sole further comprising a first flex joint and a second flex joint, said first flex joint extending rearwardly in a generally longitudinal direction from said front end, said first flex joint being located to extend between the hallux and the second toe of the wearer's foot, said second flex joint extending in a generally transverse direction between said medial and lateral sides, said second flex joint being positioned generally between the metatarsal heads of the wearer's foot and the pads of a plurality of toes including at least the hallux and the second and third toes of the wearer's foot, said second flex joint intersecting said first flex joint to define a first supporting section receiving and supporting only the hallux and a second supporting section receiving and supporting only collectively a plurality of other toes including at least said second and third toes, said first and second supporting sections being subdivided from the remainder of said sole by said first and second flex joints whereby the hallux supported by said first supporting section is easily and relatively independently moved by the wearer with respect to the other toes and said toes collectively supported by said second supporting section can be easily and relatively independently moved as a collective group by the wearer with respect to the hallux, said sole further including a third flex joint extending transversely across said sole between the metatarsal heads and a plurality of the toe pads of the wearer's foot, said third flex joint extending generally parallel with said second flex joint to define a relatively narrow panel therebetween, said panel being movable between a rest position and an working position, said panel in said rest position being generally co-planar with the remainder of said sole, and said panel in said working position being displaced upwardly from the remainder of said sole in a direction toward said top surface to define a support ledge against which said hallux and said toes can push, said panel being positionable in said working position by plantar flexion of the wearer's toes.

3. Footwear in accordance with claim 2 in which said sole further includes a ground engaging protrusion extending outward from said relatively narrow panel to facilitate upward movement of said relatively narrow panel with substantially each step.

4. Footwear in accordance with claim 2 in which said second and third flex joints are each formed as a generally V-shaped groove in said sole, wherein each of said grooves includes a first side adjacent said relatively narrow panel and a second side remote from said relatively narrow panel, wherein said first sides converge toward one another as they extend downward toward said bottom ground-engaging surface, and wherein said second sides are in a generally parallel relationship with respect to each other.

5. Footwear in accordance with claim 2 in which said sole further includes a textile layer and a foam layer, wherein said second and third flex joints are each formed by defining a groove in said foam layer which extends to said textile layer.

6. Footwear in accordance with claim 2 in which said first flex joint extends rearward beyond said second flex joint and intersects with said third flex joint.

7. Footwear in accordance with claim 2 in which said sole further includes a fourth flex joint extending transversely across said sole generally along the first two metatarsal heads of the wearer's foot and a fifth flex joint extending along a path generally parallel to a line intersecting the third, fourth and fifth metatarsal heads of the foot, wherein said fourth and fifth flex joints converge toward said medial side of said sole.

8. Footwear in accordance with claim 7 in which said first flex joint extends rearward beyond said second flex joint to intersect with said fourth flex joint.

9. Footwear in accordance with claim 7 in which said first flex joint extends rearward beyond said fourth flex joint to intersect with said fifth flex joint.

10. Footwear in accordance with claim 2 in which said sole further includes a fourth flex joint extending transversely across said sole, said third and fourth flex joints being located to each side of the metatarsal heads of the wearer's foot to define a third supporting section for supporting the portion of the foot associated with the metatarsal heads.

11. Footwear for receiving and supporting a foot of a wearer having a front end, a rear end, a medial side and a lateral side, said footwear further including an upper and a sole, said upper and said sole defining a cavity for receiving the foot, said cavity being continuously open from said medial side to said lateral side proximate said front end of said footwear whereby the toes of the wearer's foot are not subdivided within the cavity relative to each other, said sole comprising a first flex joint and a second flex joint, said first flex joint extending rearwardly in a generally longitudinal direction from said front end, said first flex joint being located to extend between the hallux and the second toe of the wearer's foot, said second flex joint extending in a generally transverse direction between said medial and lateral sides, said second flex joint being positioned generally between the metatarsal heads of the wearer's foot and the pads of a plurality of toes including at least the hallux and the second and third toes of the wearer's foot, said sole further including a third flex joint extending transversely across said sole, said second flex joint being located forwardly of the metatarsal heads and said third flex joint being located rearward of the metatarsal heads of the wearer's foot, said first flex joint extending rearwardly to intersect said second and third flex joints to define a first supporting section receiving and supporting the hallux and a second supporting section receiving and supporting collectively a plurality of other toes including at least said second and third toes, said first and second supporting sections being subdivided from the remainder of said sole by said first and third flex joints whereby the hallux supported by said first supporting section is easily and relatively independently moved by the wearer with respect to the other toes and said toes collectively supported by said second supporting section can be easily and relatively independently moved as a collective group by the wearer with respect to the hallux.

12. A sole for footwear having a medial side, a lateral side, a front end, a rear end, a bottom surface and a generally continuous top surface for supporting the wearer's foot, said sole further comprising a first forefoot portion adjacent said medial side for supporting a medial portion of the wearer's forefoot including the hallux and a second forefoot portion adjacent said lateral side for supporting a lateral portion of the wearer's forefoot including the other toes, said first and second forefoot portions being at least partly articulated relative to one another by a generally longitudinal flex joint extending rearward from said front end along a path generally parallel with and between the hallux and second toe of the wearer's foot, said first and second forefoot portions each further including articulated supporting sections, said first forefoot portion having a first supporting section defined and located to support only the hallux and a second supporting section directly rearward of said first supporting section and being articulated with said first supporting section and a further rearward portion of said sole, said second forefoot portion having a first supporting section defined and located to support only a plurality of said other toes and a second supporting section directly rearward of said first supporting section and being articulated with said first supporting section and a further rearward portion of said sole, said second supporting sections of said first and second forefoot portions being defined and located to support at least the metatarsal heads of the wearer's foot, whereby said articulation of said supporting sections enables said hallux and said remaining toes to be substantially independently moved in dorsi flexion and plantar flexion, said second supporting sections of each of said first and second forefoot portions further including one transverse flex joint extending generally along the first two metatarsal heads of the wearer's foot and another transverse flex joint extending generally parallel to a line extending generally along said third, fourth and fifth metatarsal heads of the wearer's foot such that said one and said another transverse flex joints converge toward said medial side, said second supporting sections of each of said first and second forefoot portions further including a relatively narrow third supporting section located only under the cavity between the metatarsal heads and the toe pads of the hallux and a plurality of other toes, said third supporting section being movable upward into said cavity upon significant plantar flexion of the toes, said third supporting section and said adjacent portions of said sole being comprised of plastic panel members joined together by an elastomeric material bonded to each of the adjacent panels to join said panels together in an articulated manner.

13. Footwear for receiving and supporting a foot of a wearer having a front end, a rear end, a medial side and a lateral side, said footwear further including an upper and a sole, said upper and said sole defining a cavity for receiving the foot, said cavity being continuously open from said medial side to said lateral side proximate said front end of said footwear whereby the toes of the wearer's foot are not subdivided within the cavity relative to each other, said sole comprising first, second, and third flex joints, said first flex joint extending transversely across said sole generally along the first two metatarsal heads of the wearer's foot, said second flex joint extending along a path generally parallel to a line intersecting the third, fourth and fifth metatarsal heads of the wearer's foot such that said first and second flex joints converge toward said medial side of said sole, said third flex joint extending rearwardly in a generally longitudinal direction from said front end, said third flex joint being located to extend between the hallux and the second toe of the wearer's foot, said third flex joint intersecting said first and second flex joints to define a first supporting section receiving and supporting the hallux and a second supporting section receiving and supporting collectively a plurality of other toes including at least said second and third toes, said first and second supporting sections being subdivided from the remainder of said sole by said second and third flex joints whereby the hallux supported by said first supporting section is easily and relatively independently moved by the wearer with respect to the other toes and said toes collectively supported by said second supporting section can be easily and relatively independently moved as a collective group by the wearer with respect to the hallux.

14. Footwear in accordance with claim 13 wherein said first and second supporting sections are formed by plastic panel members which are interconnected along said flex joints by an elastomeric material which is affixed to each of the adjacent plastic panels, said elastomeric material joining said plastic panels together in an articulated manner.

* * * * *

UNITED STATES PATENT AND TRADEMARK OFFICE

CERTIFICATE OF CORRECTION

PATENT NO. : 5,384,973

DATED : 01/31/95

INVENTOR(S) : Robert M. Lyden

It is certified that error appears in the above-identified patent and that said Letters Patent is hereby corrected as shown below:

Col. 2, line 8: Insert --rearfoot-- after "excessive".
Col. 2, line 9: Delete "rearward".
Col. 2, line 47: Change ""body"" to --body--.
Col. 2, line 47: Change ""information"" to --information--.
Col. 3, line 27: Insert --are-- before "associated".
Col. 3, line 60: Insert --to-- after "force".
Col. 3, line 68: Replace "tibia 15 portion of" with --portion of tibia 10--.
Col. 4, line 1: Insert --to-- after "applied".
Col. 4, line 7: Insert --,-- after "i.e.".
Col. 4, line 15: Change "tibia 10" to --fibula 11--.
Col. 4, line 19: Change "Tibias" to --Tibialis--.
Col. 5, line 4: Replace "relative relative" with --relative inflexibility--.
Col. 5, line 13: Delete ",".
Col. 10, line 31: Insert --protrusion, such as a-- after "provision of a".
Col. 10, line 32: Change "(or lugs not shown)" to --or lugs (not shown),--.
Col. 12, line 48: Change "an" to --a--.

Signed and Sealed this

Second Day of July, 1996

*Attest:*

*Attesting Officer*

BRUCE LEHMAN

*Commissioner of Patents and Trademarks*